US006494290B1

(12) United States Patent
Jessberger

(10) Patent No.: US 6,494,290 B1
(45) Date of Patent: Dec. 17, 2002

(54) NOISE SUPPRESSOR WITH A BYPASS RESONATOR

(75) Inventor: Thomas Jessberger, Rutesheim (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/509,876

(22) PCT Filed: Sep. 5, 1998

(86) PCT No.: PCT/EP98/05636

§ 371 (c)(1),
(2), (4) Date: Apr. 3, 2000

(87) PCT Pub. No.: WO99/17012

PCT Pub. Date: Apr. 8, 1999

(30) Foreign Application Priority Data

Oct. 1, 1997 (DE) ..... 197 43 482

(51) Int. Cl.[7] ..... F01N 1/02

(52) U.S. Cl. ..... 181/250; 181/214; 181/219; 123/184.57

(58) Field of Search ..... 181/250, 214, 181/217, 219, 224, 229, 241, 253, 254, 197; 1233/184.57, 184.56, 184.55

(56) References Cited

U.S. PATENT DOCUMENTS 4,539,947 A * 9/1985 Sawada et al. ..... 123/52 M
4,546,733 A * 10/1985 Fukami et al. ..... 123/52 MB
5,283,398 A * 2/1994 Kotera et al. ..... 181/224
5,317,112 A * 5/1994 Lee ..... 181/250
5,389,845 A * 2/1995 Brimhall ..... 310/26
5,511,589 A * 4/1996 Scruggs ..... 140/123.6
5,546,975 A * 8/1996 Pernet ..... 123/563
5,690,391 A * 11/1997 Kingsley et al. ..... 125/14
5,771,851 A * 6/1998 McLean ..... 123/184.57

FOREIGN PATENT DOCUMENTS

EP 0 649 982 A * 4/1995 ..... F02M/35/12
JP 60 182348 A * 9/1985 ..... F02M/35/12
JP 61129414 A * 6/1986 ..... F01N/1/02
JP 03 000963 A * 1/1991 ..... F02M/35/12
JP 05257482 A * 10/1993 ..... 181/224

* cited by examiner

*Primary Examiner*—Brian Sircus
*Assistant Examiner*—Edgardo San Martin
(74) *Attorney, Agent, or Firm*—Crowell & Moring LLP

(57) ABSTRACT

A silencer is disclosed with a bypass resonator (4; 9, 12) connected by at least one tubular connection (3*a*, 3*b*; 7, 8; 13) to a sound-transmitting channel (1). The tubular connection (3*a*, 3*b*) can have various lengths (La, Lb), tubular connections (7, 8) of different thicknesses can be connected, or the volume (V1, V2, Vn) of the bypass resonator (13) can be variable.

8 Claims, 3 Drawing Sheets

NOISE SUPPRESSOR WITH A BYPASS RESONATOR

BACKGROUND OF THE INVENTION

The invention relates to a noise suppressor with a bypass resonator.

Connecting a bypass resonator to a noise suppressor in the air intake duct of an internal combustion engine is already disclosed in AT Patent 216,292. Such a bypass resonator leads to an improvement of the noise suppressor, especially near its natural resonance frequency, this frequency being determined by the dimensions and geometric configuration of the bypass resonator, also known as a Helmholtz resonator in shunt. To make it possible to adapt to different sound conditions, complex mechanical devices or a separate resonator for every sound condition are often necessary.

OBJECT OF THE INVENTION

It is the object of the invention to provide a noise suppressor of the kind referred to above such that the (noise) damping characteristics can be influenced in a simple manner.

SUMMARY OF THE INVENTION

The noise suppressor according to the invention is advantageously able, to achieve the stated object as described and claimed hereinafter. Because the tubular connections between the sound-carrying duct and the bypass resonator are exchangeable parts which extend with various respective lengths into the bypass resonator, different natural resonances of the system can be adjusted in a simple manner.

In a second advantageous working embodiment of the invention, at least two tubular connections each having a different diameter are present, which are respectively connected with the bypass resonator through an alternately closing and opening flap valves; in an additional position, both can also be open or both can be closed. This control flap is mechanically simple to make, and its switching operation—in the case of a rotating control flap, for example, which depending on its rotational position respectively closes one opening and opens the other—can be accomplished by an electric motor or also by a pressure chamber.

In a third working embodiment, the tubular connection is connected to a bypass resonator of a type whose volume which can be coupled to the tubular connection can be increased or decreased by means of a control flap. For example, the tubular connection can be coupled to the cylindrical outer surface of a hollow cylindrical bypass resonator, and the volume in the interior of the bypass resonator can be defined on one side by a stationary wall from the central axis to the outside wall and on the other side by movable wall which is continuously displaceable around the central axis or which can locked in various position settings.

Advantageously, the adjustment of the above-described pivotable flap or the wall can be effected by means of an electric motor or a pressure chamber. In the case of adjustment by means of the pressure chamber a push rod operated by the pressure chamber, which can be stopped in prescribed positions, can be provided. The latching of the push rod in the stops or switching positions can be achieved for example by a ball which catches under the pressure of a spring in recesses in the push rod. Without this push rod according to the embodiment, a pressure chamber operation, for example through a magnetic control valve, would catch only in the front and in the rear position when the vacuum is applied or is not applied.

In the case of a preferred application, the sound carrying duct is the intake duct for the intake air of an internal combustion engine and the noise emissions to be suppressed are generated by the air intake pulses of the individual cylinders. In the above-described embodiment with a pressure chamber and a push rod, one adjustment position for the adjustment of the resonator can be set in a state in which the intake duct vacuum is greatest in the low rotational speed range of the internal combustion engine and thus the vacuum box spring is compressed. A second adjustment position can be set in the case of weaker intake duct vacuum in the middle rotational speed range, and a third adjustment position can be set in the case of very weak intake duct vacuum in the higher rotational speed range and stronger spring force of the pressure chamber toward the push rod.

These and additional features of preferred embodiments of the invention will be found not only in the claims but also in the description and the drawings, whereby the individual features can be realized individually or jointly in the form of subcombinations in embodiments of the invention and in other fields and may represent advantageous as well as independently patentable embodiments, for which protection is hereby claimed.

BRIEF DESCRIPTION OF THE DRAWINGS

Embodiments of the noise suppressor of the invention with a bypass resonator will be further explained with reference to the figures of the drawing.

DETAILED DESCRIPTION OF PREFERRED EMBODIMENTS

Figure 1:
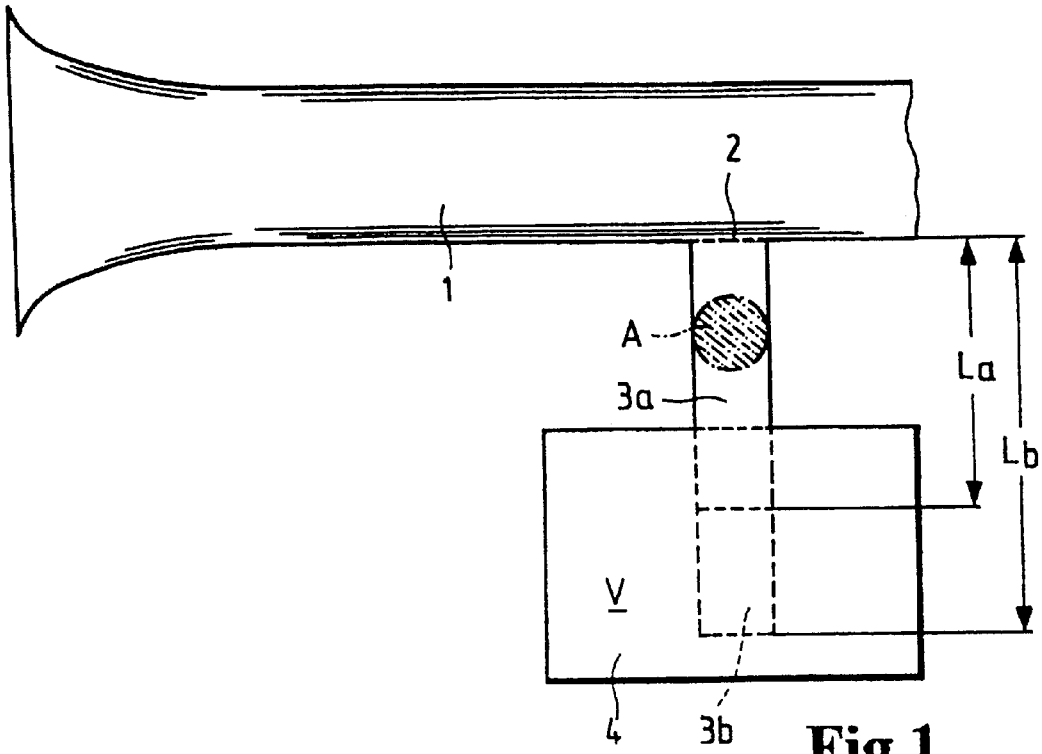
FIG. 1 shows a first working embodiment with different insert parts as tubular connections between the sound carrying passage and the bypass resonator.

In the first embodiment according to FIG. 1 of the drawing an air intake duct 1 is shown as the sound carrying duct which serves to supply aspirated air to an internal combustion engine, not described in further detail here. On the intake duct 1 there is an opening 2 to which a tubular connection 3*a* to a housing volume V is coupled, which acts as a bypass resonator 4 for the sound vibrations of the pulsating intake air in the intake duct 1. The tubular connection 3*a* here with the length La is exchangeable with another tubular connection 3*b* with the length Lb.

The sound damping characteristic of the arrangement illustrated in FIG. 1 is determined in particular by the volume V, by the lengths La and Lb of the tubular connection 3*a*, 3*b* and by the respective cross-sectional area A of the tubular connection 3*a*, 3*b*. These three above-mentioned magnitudes determine the natural resonance frequency of the bypass resonator 4. In the working embodiment according to FIG. 1, the length L (La, Lb) represents the variable parameter for adapting the value of the natural resonance frequency to the desired sound damping characteristics.

Figure 2:
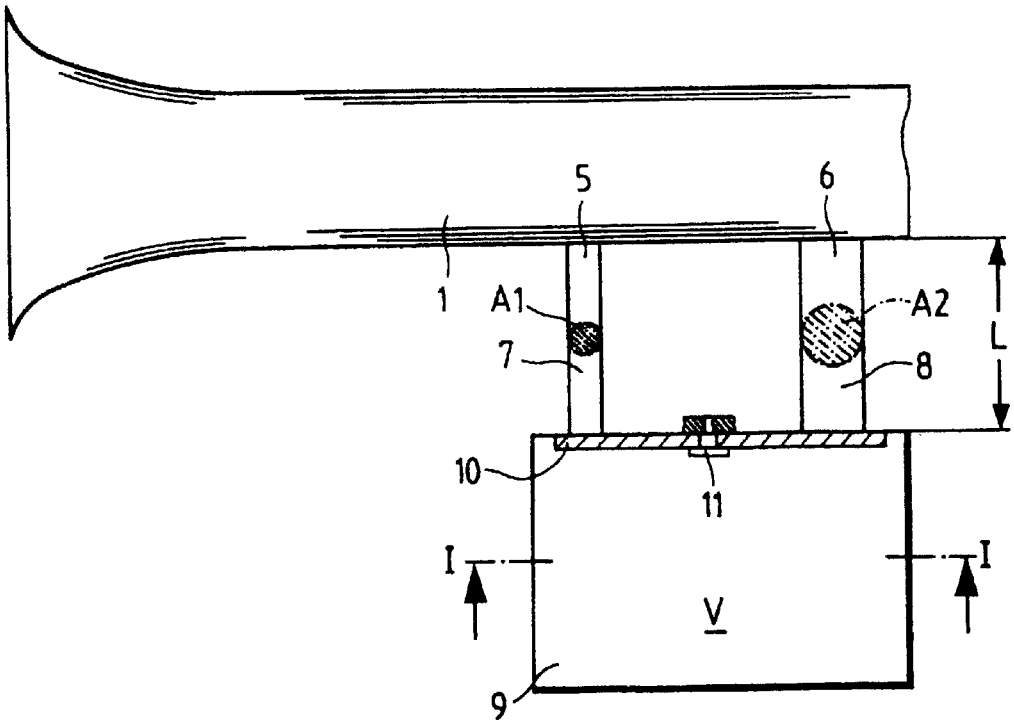
FIG. 2 shows a second working embodiment with two respective alternately opening and closing tubular connections between the sound carrying passage and the bypass resonator.
Figure 3:
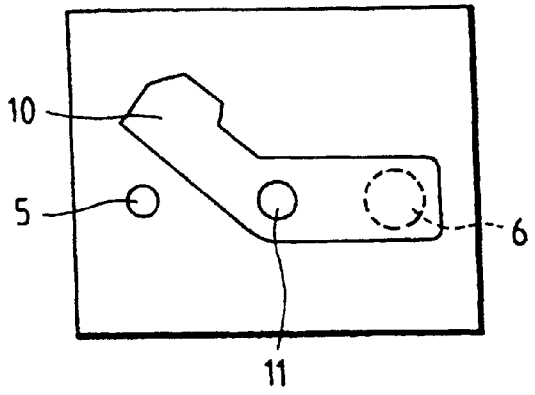
FIG. 3 shows a detail view in section I—I of FIG. 2 of a pivotable flap for closing and opening the respective tubular connection according to FIG. 2.

In the working embodiment according to FIG. 2, there are two openings 5 and 6 for two tubular connections 7 and 8 with the respective cross-sectional areas A1 and A2. At the respective points of connection to the bypass resonator 9 with the volume V a pivotable flap 10 is mounted with which the openings 5 and 6 can be alternately closed and opened, or also both can be opened or closed. In FIG. 3 the pivotable flap 10 can be seen in a plan view.

By rotating about a pivot point 11 the vane of the rotary valve 10 can alternately close the openings 5 and 6 so that here the cross-sectional areas A1 and A2 represent the variable parameters for adjusting the natural resonance frequency. The rotation of the pivotable flap 10 can be realized, for example, by an electric motor or also by a pressure chamber. For this purpose the vacuum from the intake duct or from a vacuum reservoir can be used in combination with a magnetic control valve.

Figure 4:
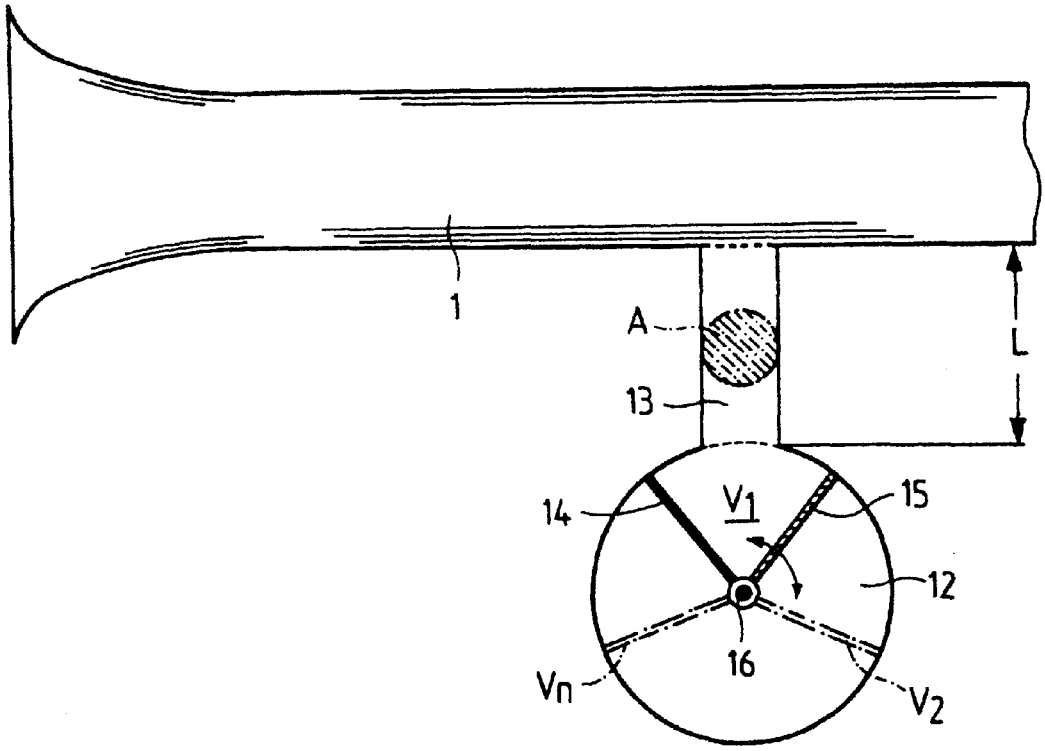
FIG. 4 shows a third working embodiment with an adjustable flap in the bypass resonator.

A third working embodiment according to FIG. 4 has a bypass resonator 12 which comprises a hollow cylinder with a variable volume V1, V2 and Vn. The connection to the intake duct 1 here is formed by a tubular connector 13 having a constant cross-sectional area A and a constant length L. Here a wall 14 is fixedly mounted in the hollow cylinder on one side of the connection to the tubular connection 13; an adjustable wall 15 is mounted for rotation about a central axis 16.

In a first position a volume V1 can be achieved with the walls 14 and 15 according to FIG. 4, and in a second position, shown here in broken lines, a volume V2 can be achieved. Additional volumes Vn can be created in any desired rotational position of the wall 15 by a catch mechanism or by continual adjustment of the wall 15. As in the second working embodiment according to FIG. 2, the adjustment of the wall 15 can be accomplished by an electric motor or by a pressure chamber.

Figure 5:
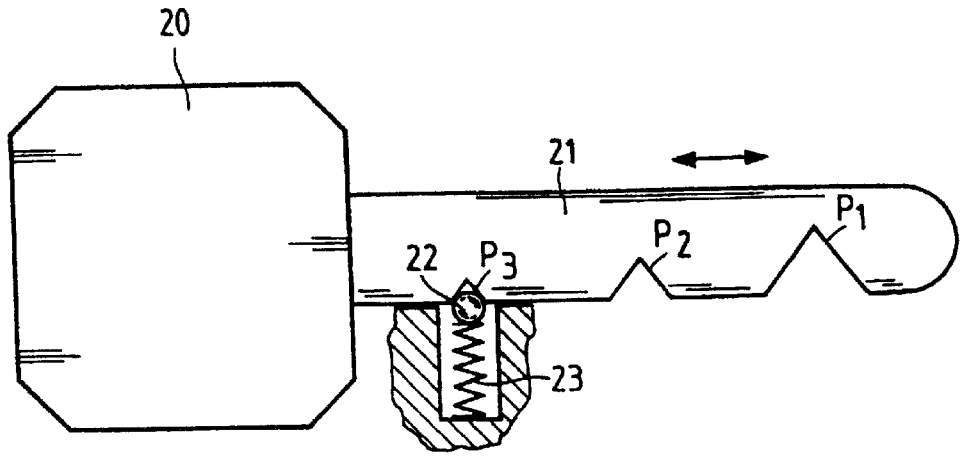
FIG. 5 shows a schematic view of a pressure chamber control of the bypass volume with a push rod.

In FIG. 5 can be seen a pressure chamber 20 which can be used for controlling the pivotable flap 10 or the wall 15.

With the pressure chamber spring, which is not visible here, in the interior of the pressure chamber 20 a push rod 21 is operated which can be stopped in the position settings P1, P2 and P3, and which thereby achieves the aforedescribed adjustment possibilities by catching the pivotable flap 10 or wall 15. The catching can be performed here with a stationary ball 22 which is urged into engagement in the position settings P1, P2 or P3 by a spring 23.

Figure 6:
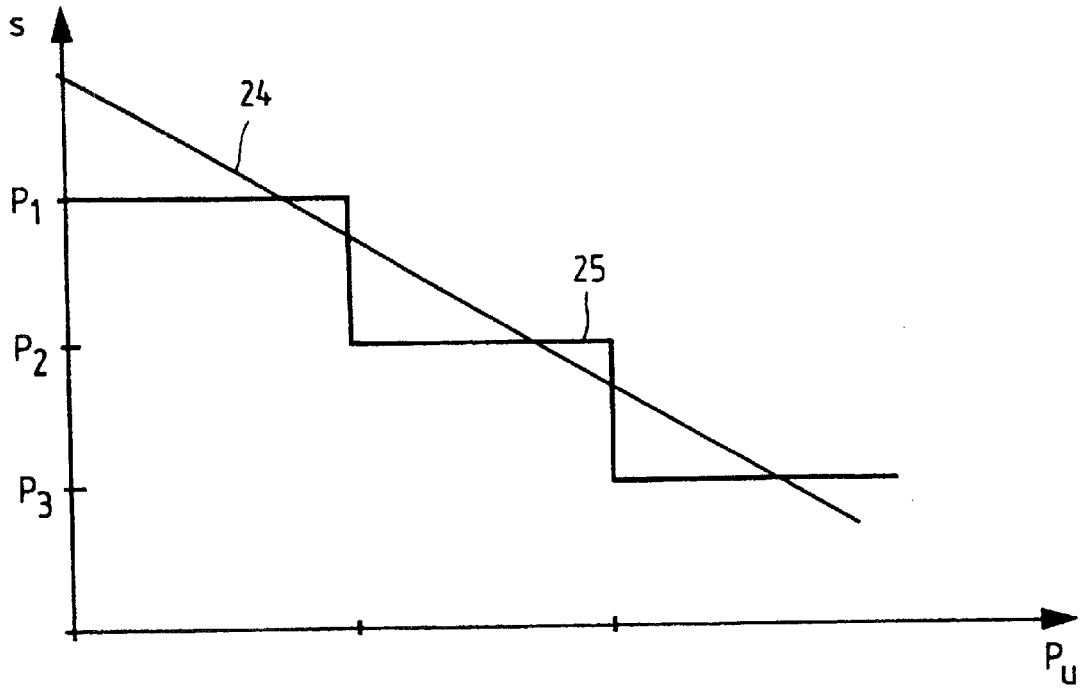
FIG. 6 shows a diagram of the course of the pressure of the pressure chamber and of the path of movement of the push rod according to FIG. 5.

In FIG. 6 there is shown a diagram which indicates on the one hand the descending pressure curve 24 in the vacuum chamber 20 and on the other hand the stepped progress 25 of the push rod 21 with the detents at the position settings P1, P2 and P3 in relation to the distance s and to the course of the pressure $P_u$ P1 here corresponds to the state in which the intake duct vacuum $P_u$ in the low rotational speed range of the internal combustion engine is at its highest and the vacuum chamber spring is thereby compressed. P2 corresponds to the second position setting at a weaker intake duct vacuum $P_u$ in the middle rotational speed range, and P3 to the third position setting at a very weak air intake duct vacuum $P_u$ in the high rotational speed range and stronger spring force of the pressure chamber 20 in the direction of the push rod 21.

What is claimed is:

1. A noise suppressor for a noise-carrying duct comprising:

a bypass resonator and at least one tubular connection connecting an interior volume of the bypass resonator to the sound carrying duct, wherein the bypass resonator contains a fixed wall and an adjustable wall by means of which the interior volume of the bypass resonator, which is coupled to the sound-carrying duct by the at least one tubular connection, can be increased or decreased, and wherein the length and cross-section of the at least one tubular connection remain constant with the increase or decrease of the interior volume of the bypass resonator.

2. A noise suppressor according to claim 1, further comprising an electric motor connected to said adjustable wall for adjusting the position of said adjustable wall.

3. A noise suppressor according to claim 1, further comprising a pressure chamber connected to said adjustable wall for adjusting the position of said adjustable wall.

4. A noise suppressor according to claim 1, wherein the bypass resonator is a hollow cylinder, and the tubular connection is connected laterally to the cylinder surface, and the adjustable wall is a pivotable flap mounted for rotation about the central axis of the hollow cylinder.

5. A noise suppressor according to claim 4, further comprising means for locking the adjustable wall in various control positions.

6. A noise suppressor according to claim 4, further comprising a pressure chamber and a push rod connected between said pressure chamber and said pivotable flap and controlled by said pressure chamber for adjusting the position of said pivotable flap, and means for locking said push rod and said pivotable flap in various position settings.

7. A noise suppressor according to claim 1, further comprising a pressure chamber and a push rod connected between said pressure chamber and said adjustable wall and controlled by said pressure chamber for adjusting the position of said adjustable wall, and means for locking said push rod and said adjustable wall in various position settings.

8. A noise suppressor according to claim 1, wherein said sound-carrying duct is an air intake duct for an internal combustion engine, and the sound emissions to be suppressed are generated by intake pulses of individual cylinders of the internal combustion engine.

* * * * *